United States Patent [19]

Focke et al.

[11] Patent Number: 5,046,617

[45] Date of Patent: Sep. 10, 1991

[54] APPARATUS FOR THE FEEDING OF BLANKS TO A PACKAGING MACHINE

[75] Inventors: Heinz Focke; Oskar Balmer, both of Verden, Fed. Rep. of Germany

[73] Assignee: Focke & Co. (GmbH & Co.), Verden, Fed. Rep. of Germany

[21] Appl. No.: 387,664

[22] Filed: Jul. 31, 1989

[30] Foreign Application Priority Data

Aug. 17, 1988 [DE] Fed. Rep. of Germany ..... 3827916

[51] Int. Cl.[5] ..... B65D 21/04; B65D 81/24

[52] U.S. Cl. ..... 206/507; 206/505; 206/511; 206/518

[58] Field of Search ..... 206/505, 507, 509, 511, 206/512, 515, 518, 519, 520, 558, 561, 585; 211/188, 194; 414/795.8

[56] References Cited

U.S. PATENT DOCUMENTS

| | | | |
|---|---|---|---|
| 3,172,538 | 3/1965 | Fowler | 206/509 X |
| 3,319,799 | 5/1967 | Paxton | 206/507 X |
| 4,410,099 | 10/1983 | deLarosiere | 206/509 X |
| 4,601,393 | 7/1986 | Veenman et al. | 206/511 X |
| 4,671,411 | 6/1987 | Rehrig et al. | 206/511 X |
| 4,907,941 | 3/1990 | Focke et al. | 414/795.8 |

FOREIGN PATENT DOCUMENTS

| | | |
|---|---|---|
| 150511 | 8/1985 | European Pat. Off. . |
| 168060 | 1/1986 | European Pat. Off. . |
| 258597 | 3/1988 | European Pat. Off. . |
| 7438565 | 3/1975 | Fed. Rep. of Germany . |
| 2532297 | 1/1977 | Fed. Rep. of Germany . |
| 2722749 | 12/1977 | Fed. Rep. of Germany . |
| 2755858 | 6/1979 | Fed. Rep. of Germany . |
| 3227593 | 3/1983 | Fed. Rep. of Germany . |
| 3307675 | 9/1984 | Fed. Rep. of Germany . |
| 3811993 | 11/1988 | Fed. Rep. of Germany . |
| 2047663 | 12/1980 | United Kingdom . |

*Primary Examiner*—Robert J. Spar
*Assistant Examiner*—Janice Krizek
*Attorney, Agent, or Firm*—Sughrue, Mion, Zinn, Macpeak & Seas

[57] ABSTRACT

For the transport of blank stacks (22) to a packaging machine, there are reusable cassettes (21) which have chambers (23) for receiving a multiplicity of blank stacks (22). The cassettes (21) are filled with the blank stacks (22) in a paper factory and are emptied in the region of the packaging machine. The cassettes (21) are designed so that several emptied cassettes (21) can be nested in one another and returned as a space-saving unit to the paper factory. Furthermore, the cassettes (21) are designed so that they can be transported by overhead conveyors, without any manual labor being involved.

7 Claims, 12 Drawing Sheets

48
49
21
29
29
30
25
45
51
43
50

APPARATUS FOR THE FEEDING OF BLANKS TO A PACKAGING MACHINE

BACKGROUND OF THE INVENTION

The invention relates to an apparatus for the feeding of stacks of blanks for the production of packs, especially of hinge-lid packs for cigarettes, to a packaging machine.

The increasing performance of packaging machines presents problems in supplying them with sufficient quantities of packaging material. This applies, above all, to the production of packs from punched blanks prefabricated outside the packaging machine. An example of this is hinge-lid packs for cigarettes which are made from blanks of thin cardboard produced by punching in a paper factory. The blanks arrive at the packaging machine in the form of a blank stack.

The packaging machine is conventionally equipped with a blank magazine of relatively low capacity. A certain stock of stacked blanks can be introduced into this.

SUMMARY OF THE INVENTION

The subject of the invention is the transport of blanks produced and stacked outside the packaging installation, especially in a paper factory, to the packaging machine.

The object on which the invention is based is to provide measures for an efficient transport of relatively large quantities of stacked blanks from the production shop to the processing installation, especially to the packaging machine, at the same time involving only a relatively small amount of manual labour.

To achieve this object, the apparatus according to the invention is characterized by containers (cassettes), open at least on the top side, for receiving several blank stacks which are arranged next to one another and which are held laterally by vertical walls or wall parts of the container, especially by webs.

According to a further feature of the invention, the containers or cassettes are designed so that several empty cassettes can be nested in one another, with the result that they can be transported simply and in a space-saving way as empty stock.

The invention is based on the idea of packaging the blanks or blank stacks in re-usable containers at the place of manufacture and of transporting them in these to the place of use. After emptying, units consisting of several cassettes nested in one another (stack block) are transported back to the blank production plant. The cassettes can be brought to the packaging machine and emptied there. Alternatively, the cassettes can be transported in the region of the packaging machine and emptied directly in the region of the blank magazine of the packaging machine.

The cassettes are constructed in such a way that they consist of a load-bearing bottom wall and of a multiplicity of partition wall parts arranged on this, with a lateral limitation of chambers which each receive a blank stack. The partition wall parts are so designed and arranged that, in conjunction with orifices and additional orifices in the bottom wall, they make it possible to plug empty cassettes together. The cassettes nested or stacked in one another according to the invention constitute a space-saving unit (stack block) for the return transport to the production loading point.

Furthermore, the cassettes are designed so that (filled with blank stacks) they are stackable, for example for transport on pallets. Moreover, they are suitable for conveyance within a packaging installation by means of overhead conveyors.

Further features of the invention relate to the design of the cassettes and to apparatuses for the handling or transport of these.

An exemplary embodiment of the invention is explained in detail below by means of the drawings. In these:

DETAILED DESCRIPTION OF THE PREFERRED EMBODIMENTS

Figure 1:
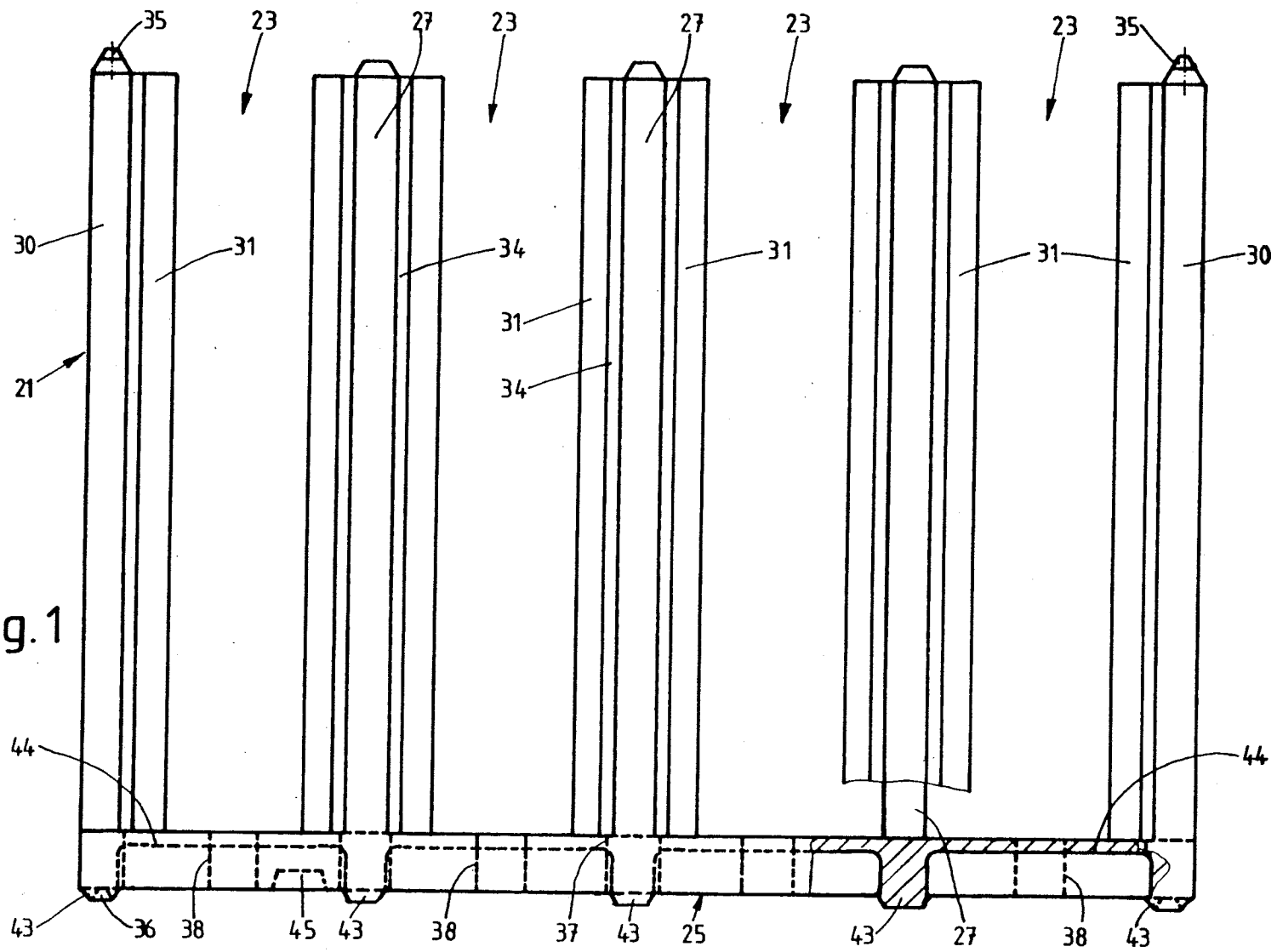
FIG. 1 shows a front view of a cassette for receiving blank stacks.
Figure 2:
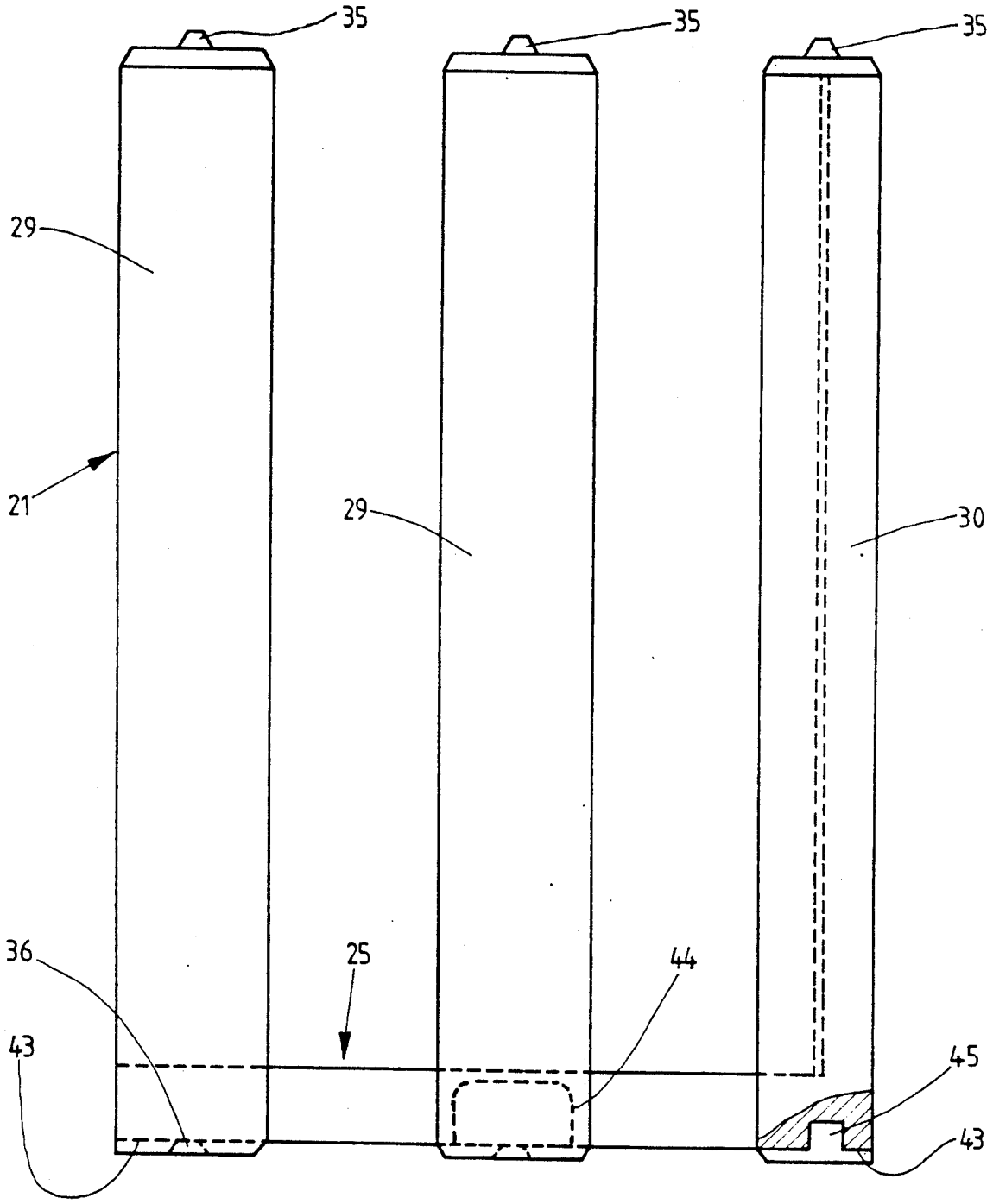
FIG. 2 shows a side view of the cassette according to FIG. 1, offset at 90°.
Figure 3:
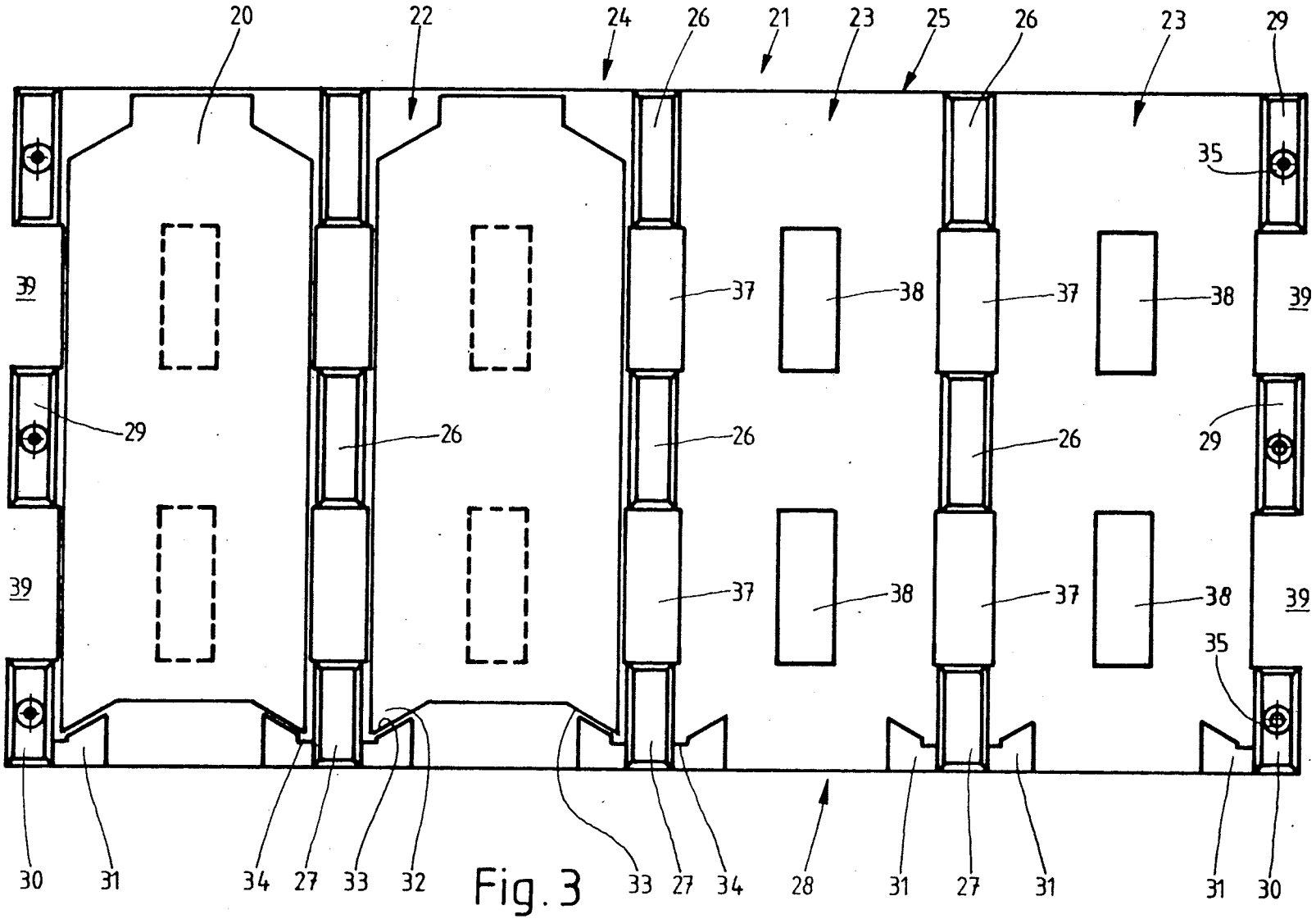
FIG. 3 shows a plan view of the cassette according to FIGS. 1 and 2, with blanks in individual chambers.

The main component of an apparatus for the transport of blanks 20 is containers or cassettes 21, in which prefabricated, that is to say punched blanks 20 are accommodated in stacked form. The present exemplary embodiment is concerned with the handling of blanks 20, such as are used in the cigarette industry for the production of hinge-lid packs. Blanks 20 with a contour typical of the design of packs of this type are shown in FIG. 3.

Figure 4:
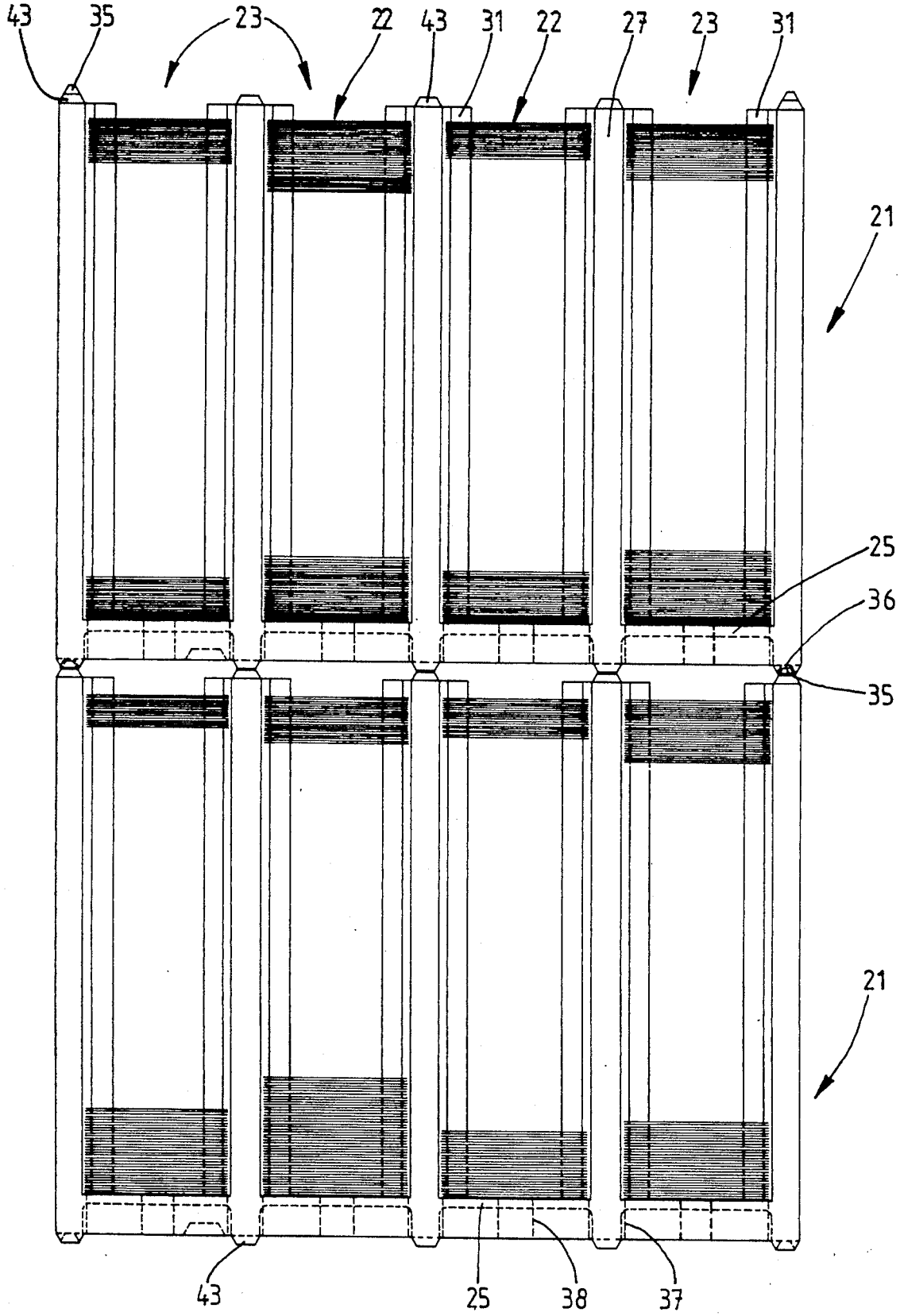
FIG. 4 shows a front view of cassettes stacked above one another with blank stacks.
Figure 5:
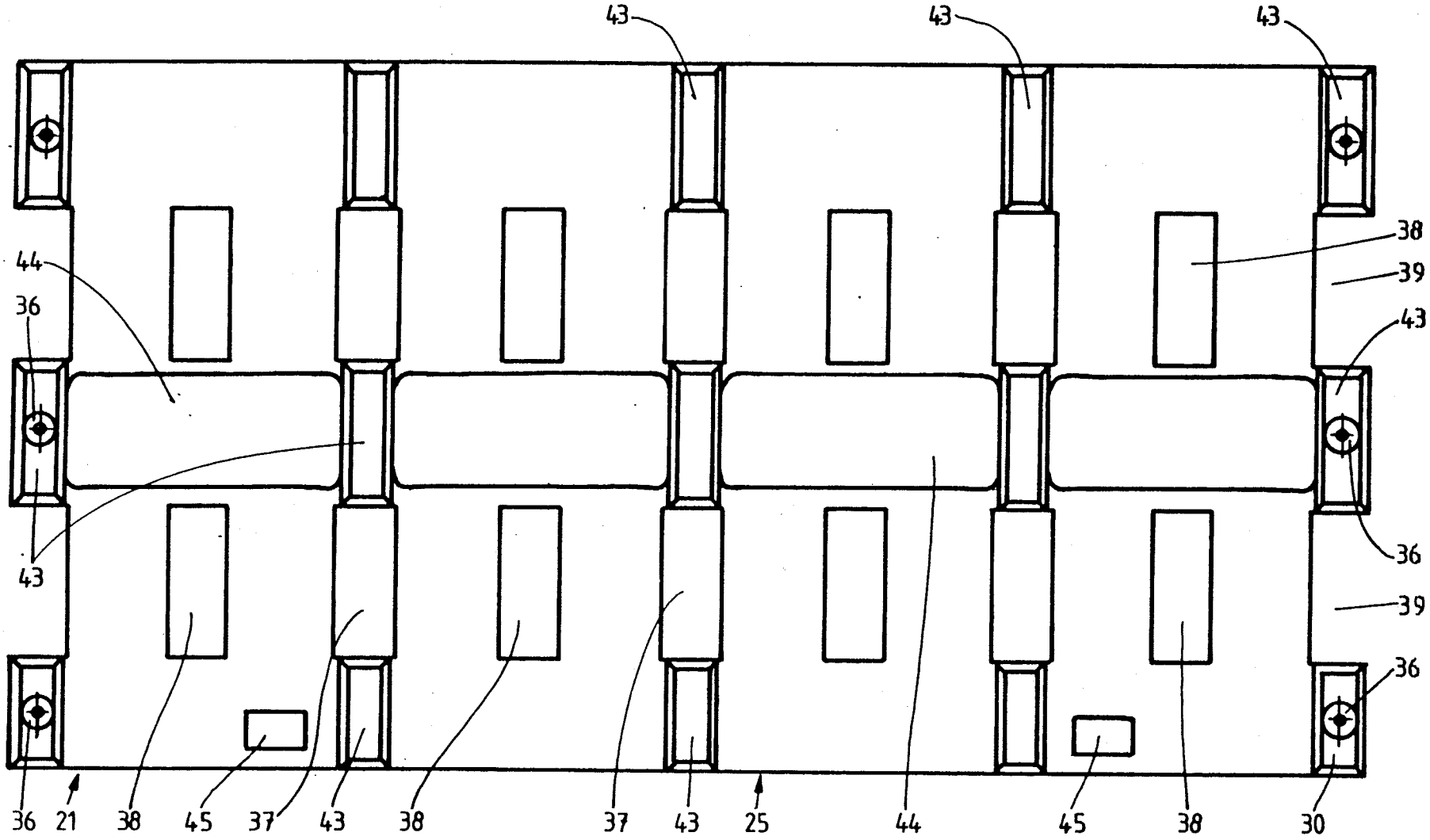
FIG. 5 shows a bottom view of a cassette.
Figure 6:
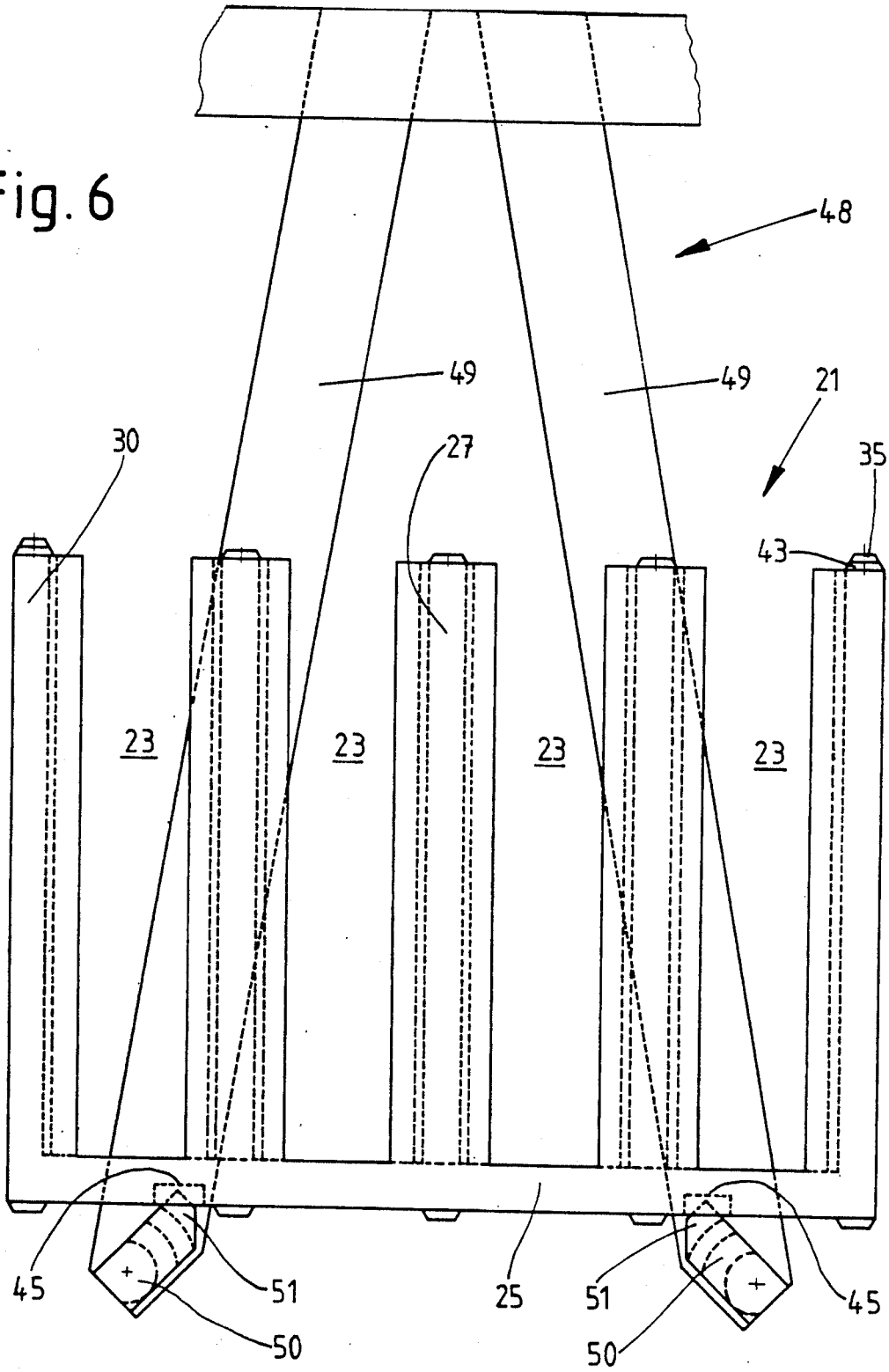
FIG. 6 shows a cassette on a fixture of a conveyor.
Figure 7:
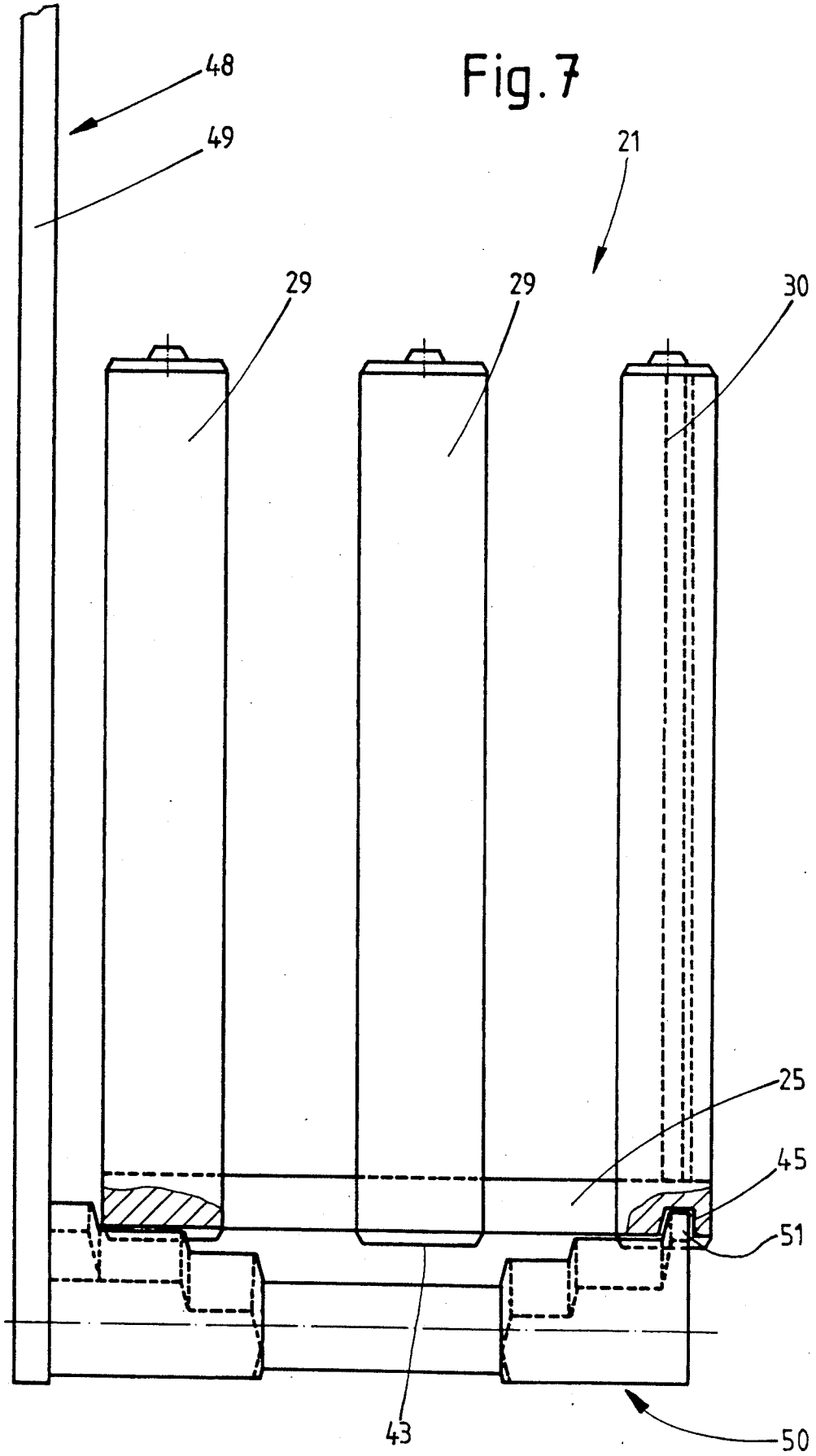
FIG. 7 shows a side view of FIG. 6, offset at 90°.
Figure 8:
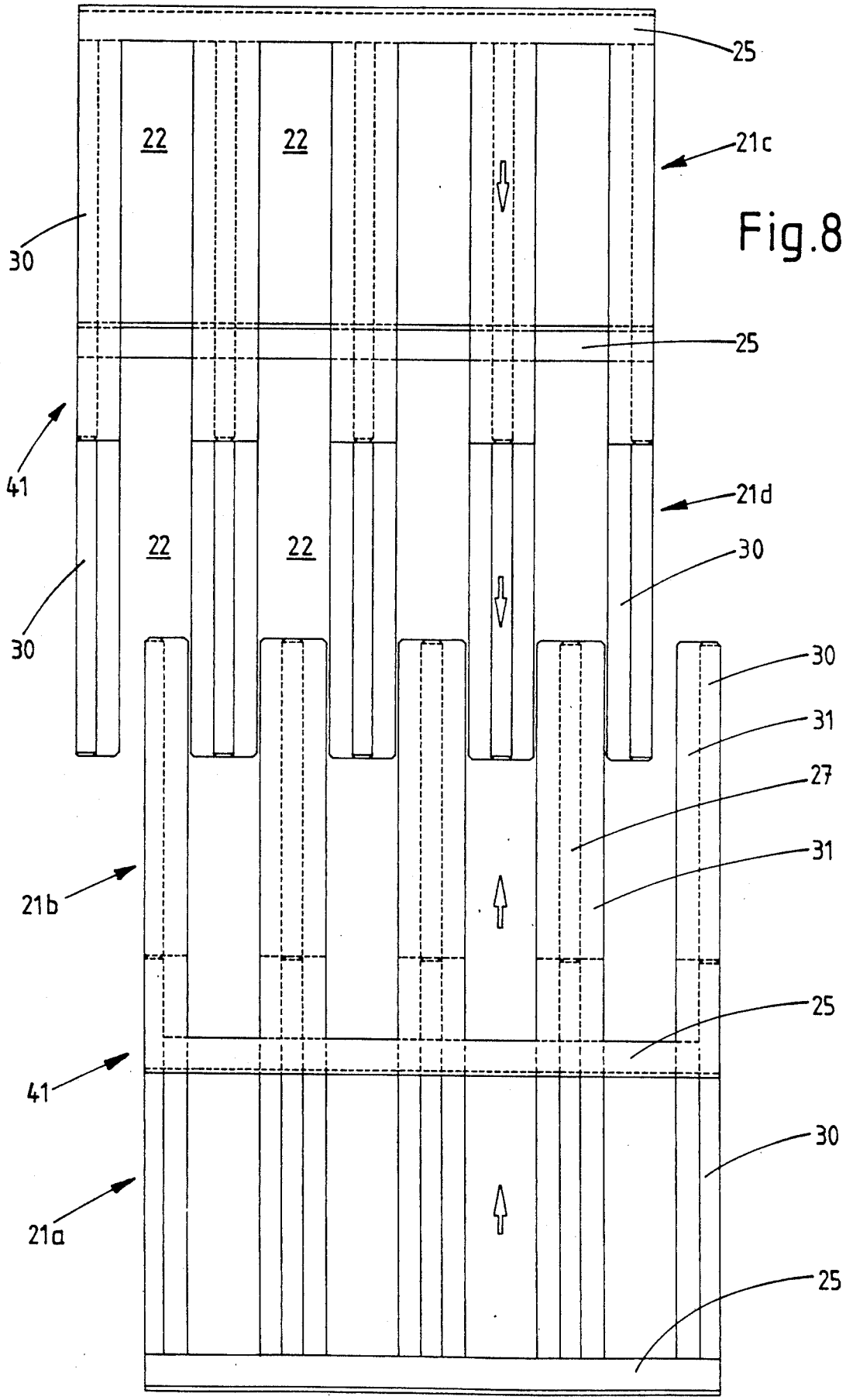
FIG. 8 shows a front view of a phase of the internesting of several (four) cassettes.

The cassettes 21 are re-usable containers which circulate between the production shop for the blanks 20, especially a paper factory, and the processing shop, especially a cigarette factory. In the paper factory, the cassettes 21 are filled with blank stacks 22. Filled cassettes 21 are then transported to the processing factory in a suitable way, for example in a stacked position on pallets or the like (FIG. 4). In the processing factory, the cassettes 21 are emptied by the extraction of the blank stacks 22. The empty cassettes 21 are then nested in one another in a specific way and returned to the paper factory in a space-saving manner as empty stock.

In the present exemplary embodiment, each cassette 21 consists of four chambers 23, each receiving a blank stack 22. The elongated chambers 23 extend over the entire width of the cassettes 21 which are rectangular, as seen in the plan view. For the loading and emptying of the cassettes 21, the chambers 23 are open on two sides, in particular at the top and on one longitudinal side of the cassette 21, namely the open side 24.

The load-bearing member of the cassette 21 is a stable bottom wall 25. The blank stacks 22 rest on this. To delimit the chambers 23 from one another, vertical partition wall members are arranged on the top side of the bottom wall 25. In the present exemplary embodiment, the chambers 23 are limited by vertical webs connected firmly to the bottom wall 25.

Here, between adjacent chambers 23, there are two equally large partition webs 26 lying in one plane and an edge web 27 located at the edge of the bottom wall 25 and extending in the same plane. In the present case, the edge web 27 has a smaller cross-section, in particular a smaller dimension in the direction parallel to the blank stacks 22, than the partition webs 26. The edge web 27 is located on that side (closing side 28) of the cassette which is closed for the retention of the blank stacks 22.

Arranged on the shorter sides of the cassette 21 are side webs 29 corresponding to the partition webs 26 and one respective corner web 30 corresponding to the edge webs 27. The outer chambers 23 are limited on the outside of the cassette 21 by the side webs 29 and corner webs 30. The above-described webs 26, 27, 29, 30 are, on the one hand, aligned in the planes parallel to the chambers 23. Furthermore, however, the webs are also aligned in rows transversely relative to the chambers 23, that is to say in the longitudinal direction of the cassette 21.

The edge webs 27 and corner webs 30 on the closing side 28 of the cassette 21 are equipped with supporting members for the bearing of the blank stacks 22. In the present case, arranged laterally respectively on the edge webs 27 and on one side of the corner web 30 are vertical supporting strips 31, against which edge regions of the blanks 20 bear positively with a fit. The special, approximately trapezoidal cross-sectional form of the supporting strips 31 emerges from the form of the blanks 20 which is characteristic of hinge-lid packs. In particular, these are designed, in the region of a front wall of the hinge-lid pack and in the region of adjoining side tabs, to form side walls of the hinge-lid pack with tooth-shaped projections 32. The blanks 20 bear by means of these triangular projections 32 or by means of their oblique edges 33 against oblique supporting faces of the correspondingly shaped supporting strips 31. Formed in the region where these adjoin the edge web 27 or corner web 30 is a vertical groove 34, into which the outermost tip of the projection 32 penetrates and is thereby protected against damage.

The cassettes 21 filled with blank stacks 22 are designed to be stacked, for example on pallets. In order, at the same time, to prevent relative shifts of the cassettes 21 in relation to one another, an inter-meshing of the cassettes 21 arranged above one another is provided. In the exemplary embodiment illustrated, the side webs 29 and the corner webs 30 are equipped, on the top side and underside, with projections for positive engagement. As shown, arranged on the top side of the abovementioned webs 29, 30 are conical centering lugs 35 which, during stacking (FIG. 4), penetrate positively into corresponding conical depressions 36 on the underside of the identical corresponding webs 29, 30. The abovementioned members have a self-centering effect during the stacking of the cassettes 21.

However, the suitability of the (empty) cassettes for a space-saving stacking nested in one another is of particular importance. For this purpose, orifices 37 and additional orifices 38 are arranged in the bottom wall 25. These are matched in terms of size and shape to the partition webs 26, so that the latter can be inserted alternately through the orifices 37 or additional orifices 38 for the nesting of cassettes 21.

The orifices 37 and 38 are respectively arranged aligned in longitudinal and transverse rows. Located on the edge of the bottom wall 25, particularly on its narrow sides, and between adjacent edge webs 27 or corner webs 30 are recesses 39 which are open to the side. The dimensions of these correspond to the crosssectional dimensions of the side webs 29.

The number of orifices 37 and that of the additional orifices 38 correspond respectively to the number of partition webs 26 of a cassette 21. The partition webs 26 of two cassettes 21 can thereby be guided completely or partially through the bottom wall 25 of a third cassette. The arrangement is such that orifices 37 are arranged respectively in the same plane as the partition webs 26 serving for limiting a chamber 23. Here, the distance between two adjacent partition webs 26 is filled by an orifice 37. The additional orifices 38 are arranged centrally between two adjacent orifices 37, that is to say centrally within a chamber 23, and are aligned with the orifices 37, as seen in the longitudinal direction of the cassette 21. This results in two rows of orifices 37 and additional orifices 38 extending in the longitudinal direction of the cassette 21 and in recesses 39 at the edges.

Figure 9:
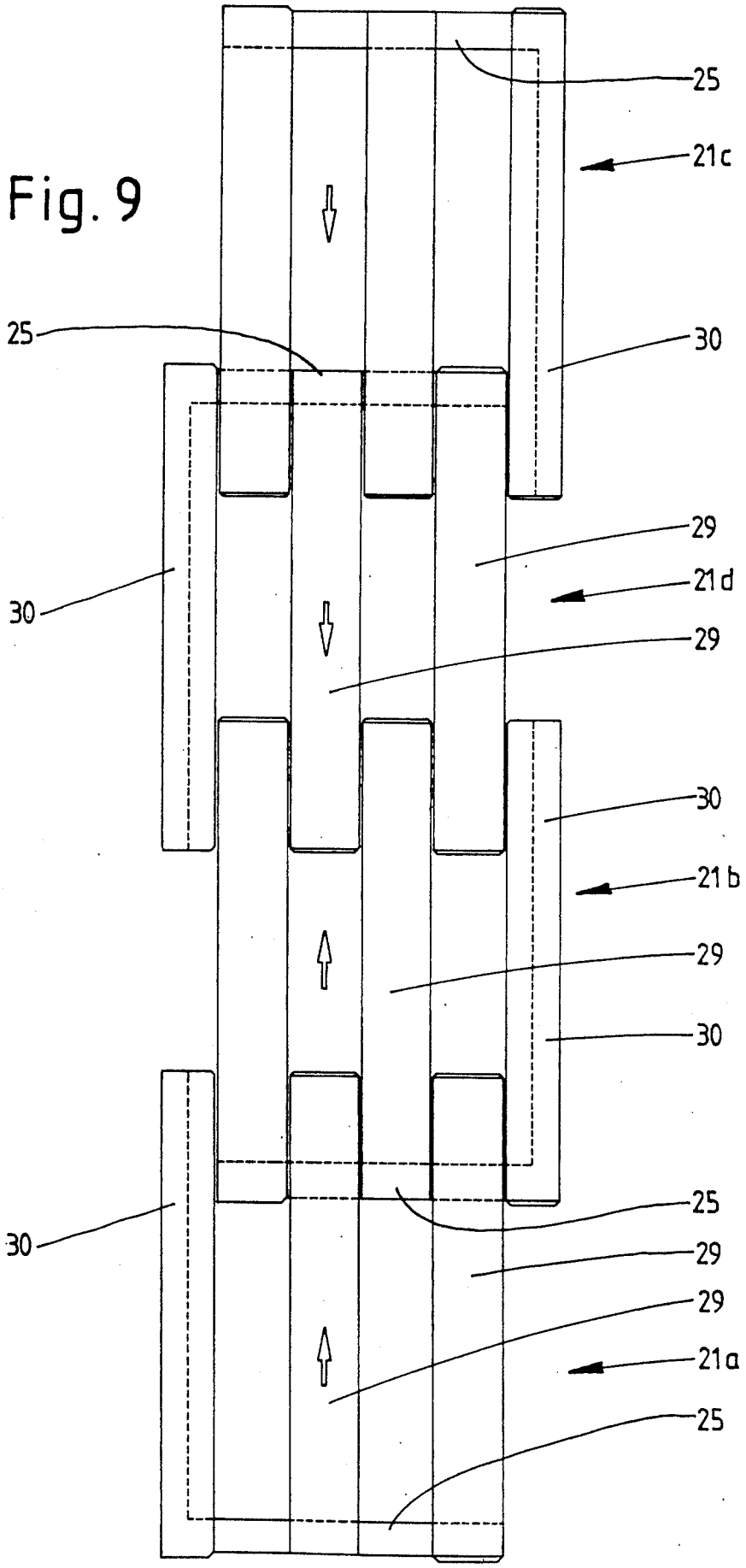
FIG. 9 shows a representation according to FIG. 8 in a side view offset at 90°.

Two cassettes **21*a*, 21*b* designed in this way, offset transversely, are nested one in the other, specifically in such a way that the partition webs 26 of one cassette 21*a* are guided from below or from the underside of the bottom wall 25 through the orifices 37 of the second cassette 21*b*. At the same time, the side webs 29 of the cassette 21*a* enter the recesses 39 of the cassette 21*b*. The partition webs 26 and the side webs 29 of the two cassettes 21*a*, 21*b* are accordingly aligned in transverse planes, but offset relative to one another, in such a way that the edge webs 27 and corner webs 30 of the two cassettes 21*a*, 21*b* extend next to the bottom wall 25 of the other respective cassette 21*a*, 21*b* (FIG. 9). For this purpose, the two cassettes 21*a*, 21*b*** are joined together, offset at 180° relative to one another.

A pair of cassettes **21*a*, 21*b* plugged together in the abovementioned way constitutes a stack unit 40 which already allows a space-saving storage of the cassettes 21*a*, 21*b***.

However, because of the design of the cassettes 21, two stack units 40, 41 with cassettes **21*a*, 21*b* on the one hand and 21*c*, 21*d* on the other hand can be nested one in the other, in such a way that a block-shaped structure, particularly a stack block 42 consisting of four cassettes 21*a* to 21*d*, is obtained. The outer dimensions of the stack block 42 are only slightly larger than the dimensions of an individual cassette 21**.

Figure 10:
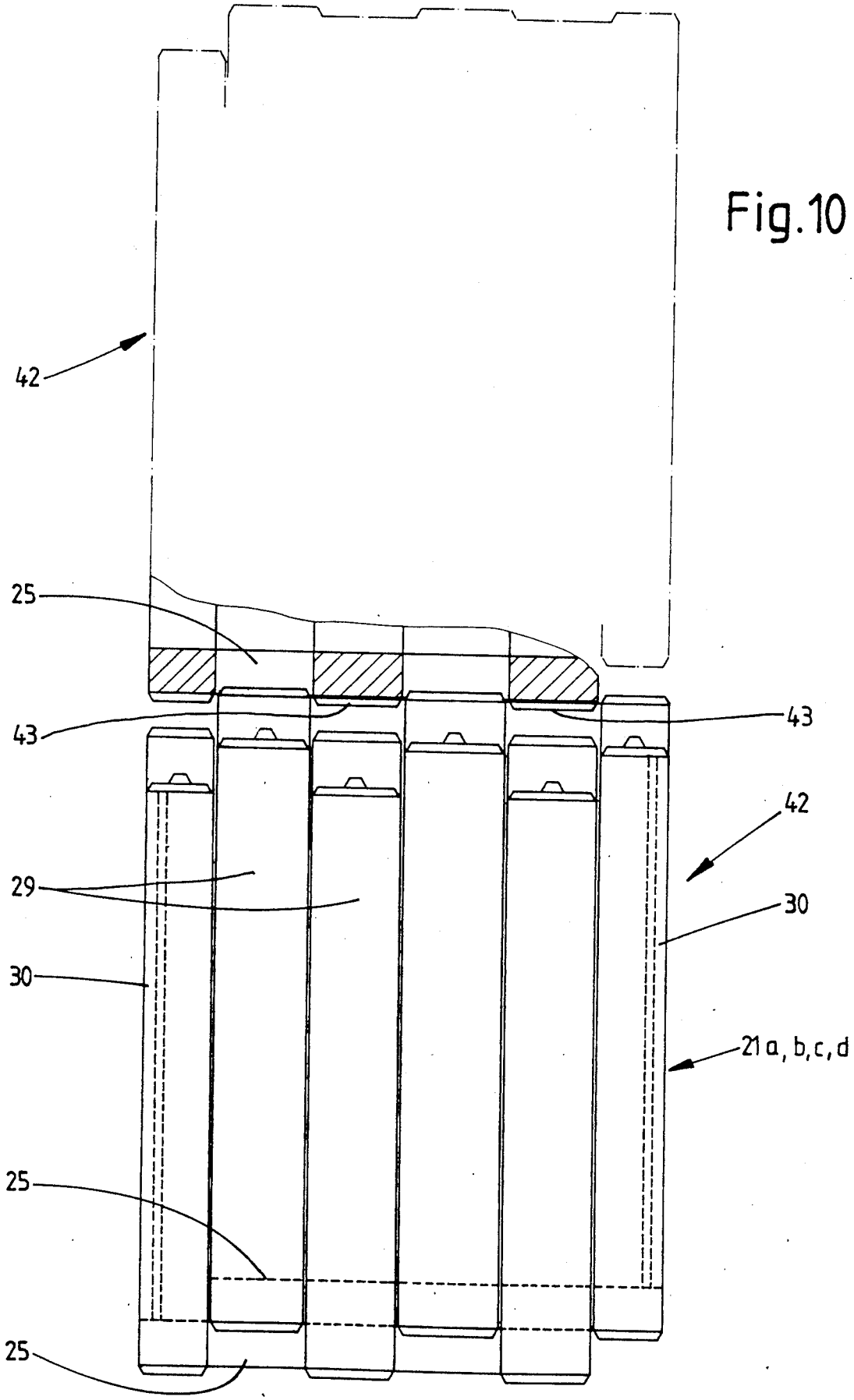
FIG. 10 shows internested cassettes stacked above one another.
Figure 11:
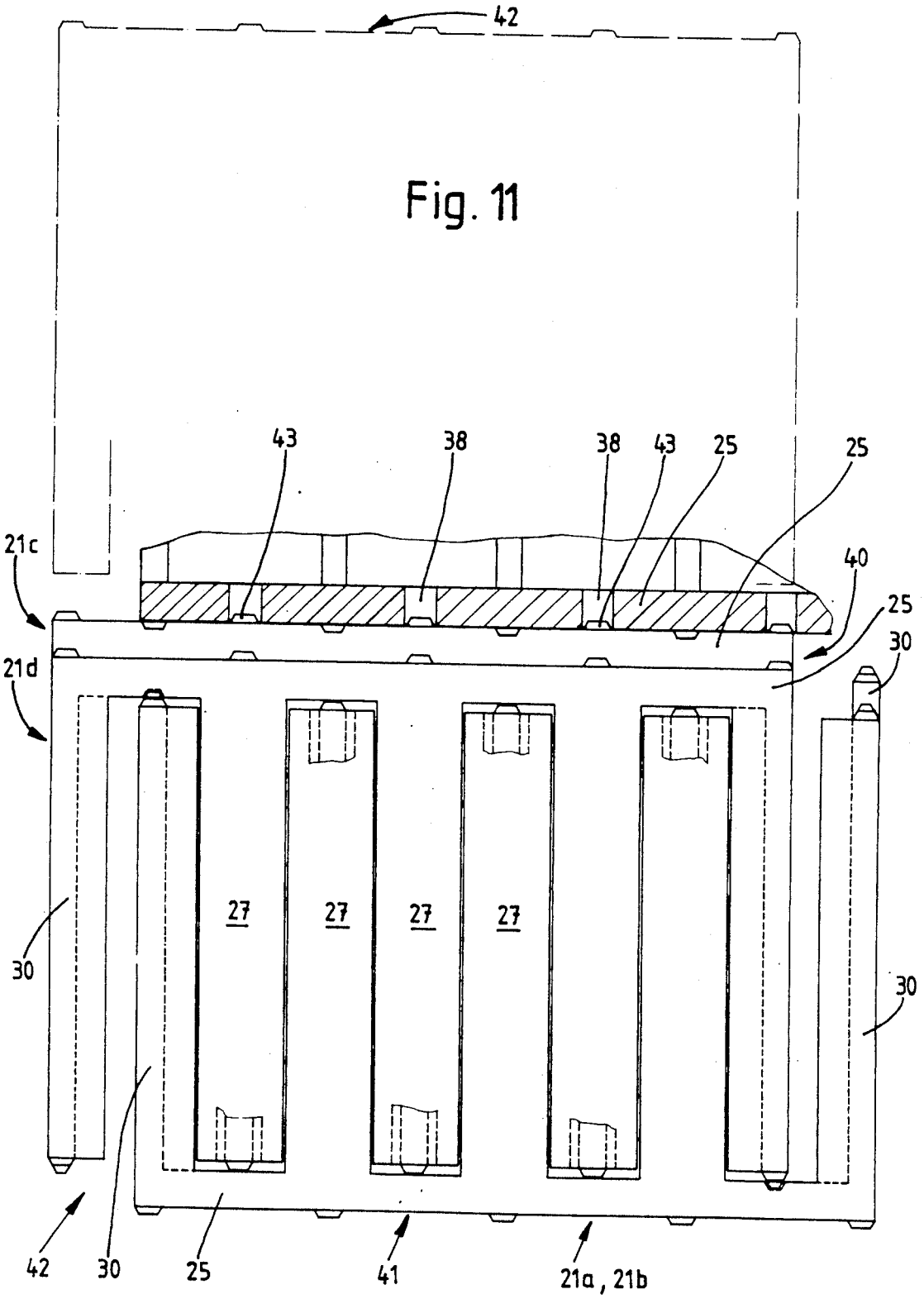
FIG. 11 shows a representation of FIG. 10 in a front view offset at 90°.

For this purpose, two stack units 40, 41 are plugged one into the other with their bottom walls 25 remote from one another. The stack units 40, 41 are at the same time offset in the longitudinal direction relative to one another by the amount of half the width of a chamber 23. The partition webs 26 and side webs 29 of the stack units 40, 41 are thereby assigned alternately to the additional orifices 38 of the confronting bottom wall 25 of the other stack unit 40, 41. The respective partition webs 26 and side webs 29 enter the additional orifices 38 (FIGS. 10 and 11). The altogether four cassettes 21 are easy to handle, particularly storable with a small space requirement, as a unit, namely as a stack block 42.

For the loading of the cassettes 21, the stack blocks 42 and stack units 40, 41 are taken apart again in the opposite direction of movement.

The partition webs 26, edge webs 27, side webs 29 and corner webs 30 are extended as far as the underside of the bottom wall 25. In particular, in this region, the bottom wall 25 is equipped with bevelled head-like projections 43 corresponding to the abovementioned webs 26, 27, 29, 30. With the cassettes 21 filled and stacked, the projections 43 on the underside of the bottom wall 25 rest on the upper ends of the webs 26, bottom wall 25 rest on the upper ends of the webs 26, 27, etc. During the stacking of inter-nested empty cassettes 21, particularly stack blocks 42 (FIG. 10), the projections 43 penetrate in a centering manner into orifices 38 of adjacent cassettes 21.

The cassettes 21 appropriately consist of a one-piece, preferably cast material, especially of plastic. In the present exemplary embodiment, depressions are formed in on the underside of the bottom wall 25, specifically, on the one hand, centre depressions 44 extending in the longitudinal mid-plane and, on the other hand, retaining depressions 45 formed in on one edge, specifically on the edge confronting the closing side 28. The first-mentioned depressions 44 extend respectively over the width of a chamber 23, and projections 43 arranged between adjacent centre depressions 44 serve as a stop for positioning the cassette 21, especially during unloading.

The retaining depressions 45 are important for the (automatic) transport of the cassettes 21.

During the supply of blanks 20 to packaging machines, the (filled) cassettes 21 are appropriately introduced into the circuit of an overhead conveyor, especially with the features of German Patent Application P3820735.4. In this older proposal, the overhead conveyor is equipped with bogie trucks 46 which are movable along a running rail 47 above the production and packaging machines. Located on the bogie trucks 46 are material holders 48 which are designed so that they can transport either reels of web-shaped packaging material or cassettes 21.

For this purpose, the material holders 48 are equipped with rigid downward-diverging carrying arms 49. Attached to the lower ends of these are respective carrier spars 50 directed transversely, that is to say projecting on one side. On these rest the articles to be transported, particularly reels or cassettes 21. Where the transport of cassettes 21 is concerned, an upward-directed nose 51 attached to the free end of each of the carrier spars 50 penetrates into the retaining depression 45 of the cassette 21. This is thus protected against shifts on the carrier spars 50 during transport.

Figure 12:
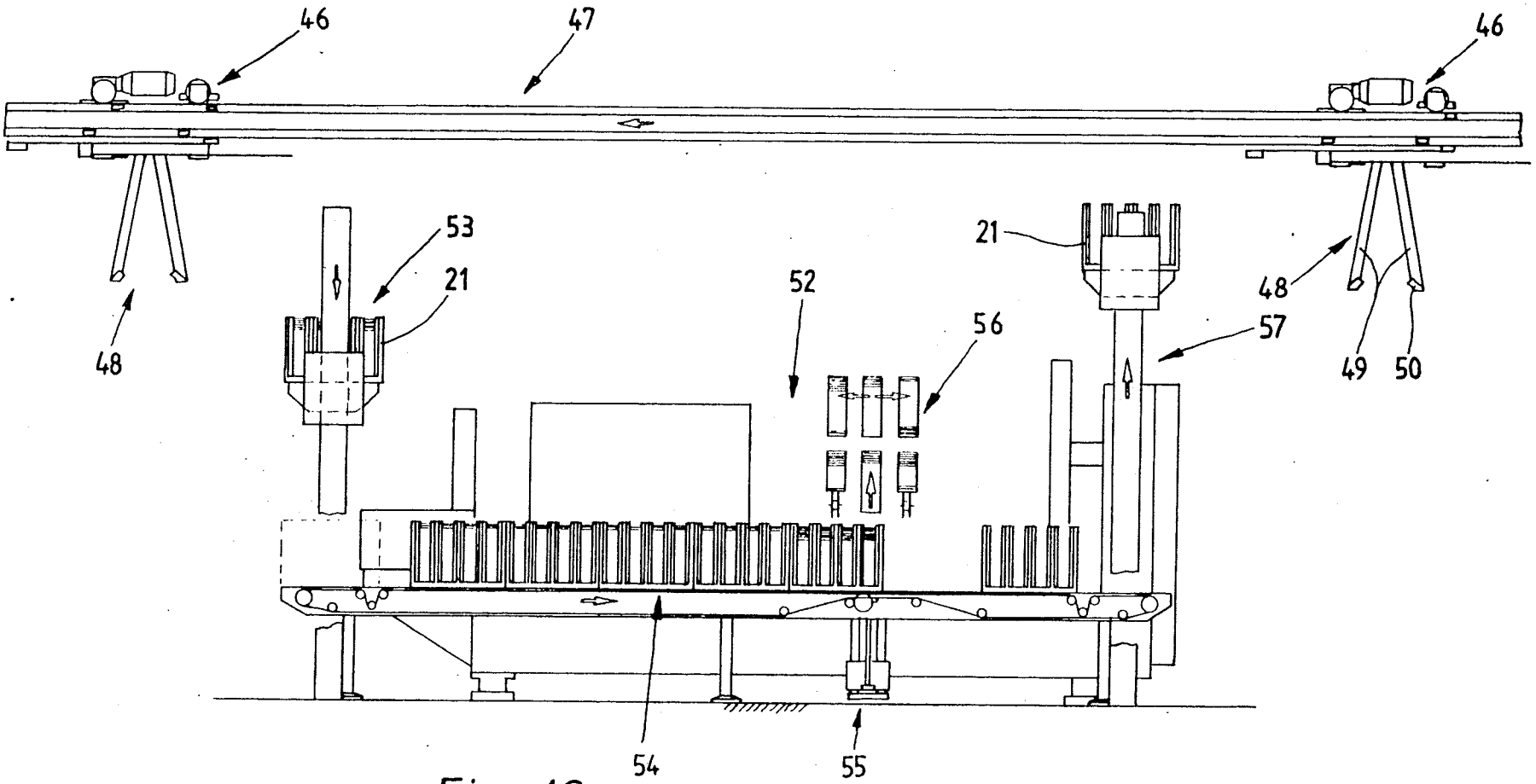
FIG. 12 shows a rear view of a packaging machine with apparatuses for the transport and handling of cassettes.

In the region of a packaging machine 52 (FIG. 12), the filled cassettes 21 are received by a first vertical conveyor 53 from the bogie truck 46 of the overhead conveyor and are conveyed downwards. The cassette 21 is deposited by the vertical conveyor 53 on a machine conveyor 54. This is arranged to run longitudinally at the rear of the packaging machine 52.

In the region of an unloading station 55, the blank stacks 22 are extracted from the cassette 21 in succession as a result of an upward movement, specifically by means of a stack lifter 56. This grasps a respective blank stack 22 and conveys it upwards and feeds the blank stacks 22 to a blank magazine (not shown) located on the machine.

The empty cassettes 21 are transported further on the machine conveyor 54 as far as a second vertical conveyor 57. This takes over the empty cassettes 21 and transfers them to a bogie truck 46 or to a material holder 48 of the latter.

The nesting of several cassettes 21 in one another is carried out at an unloading station of the continuous overhead conveyor, especially manually.

What is claimed is:

1. A cassette, having a bottom wall and side webs, for holding and feeding stacks of blanks, from which cigarette packs are produced, to a cigarette-packaging machine, wherein:

said cassette (21) is divided into several elongate individual chambers (23) which adjoin one another along sides thereof and which hold one blank stack (22) each;

lateral limitations of the individual chambers (23) are each formed by one row of a plurality of column-shaped webs (26, 27, 29, 30) extending vertically from the bottom wall (25);

the column-shaped webs (26, 27, 29, 30) terminate at a distance from the bottom wall (25) above the blank stacks (22) to be received and include projections (43) protruding from the underside of the bottom wall (25);

the column-shaped webs (26, 27, 29, 30) include conical centering lugs at their top sides, and the projections (43) located at the underside of the bottom wall (25) have corresponding conical depressions (36);

the elongate chambers (23) are open across their complete width along an open side (24) forming a front side, and said elongate chambers (23), at a closing side (28) opposite said open side (24), have stack-supporting strips (31) which at least partially close said chambers (23), which directly adjoin webs (30, 27; 27, 27) located at said closing side (28), which form the termination of the lateral limitation of the chambers (23) and which are arranged on both sides of the chambers, said supporting strips (31) beginning at the bottom wall (25) and ending above the blank stack (22) to be held;

the web rows include webs which directly adjoin the open side (24) of the chamber (23), and each of the other webs (26, 27, 29, 30) of each row forming the lateral limitation is spaced from an adjacent web by a distance which corresponds to the longitudinal dimension of the web which directly adjoins the open side;

between the webs (26, 27, 29, 30) of each of the rows, the bottom wall (25) has a plurality of first orifices (37, 39) each of which dimensionally corresponds to the cross-section of the web (29) which directly adjoins the open side; and parallel to the first orifices (37) are second orifices (38) which are of the same shape and size as the first orifices and which are located in the longitudinal mid-plane of each chamber (23); and webs (29, 30), forming the outer lateral limitations of outer ones of the chambers (23), are arranged to directly adjoin the bottom wall (25).

2. Cassette according to claim 1, wherein said first and second orifices (37, 38), for the nested stacking of several empty cassettes, are adapted to receive said webs of another said cassette (21).

3. Cassette according to claim 1, wherein:

said first and second orifices (37, 38) are aligned in two rows in the longitudinal direction of said cassette;

said bottom wall has lateral edge recesses (39) which are offset relative to said first and second orifices; and for nesting stacking of two cassettes to form a stack unit (40, 41), said first and second orifices and said recesses are adapted to receive said webs of another said cassette (21), whereby stacked cassettes aligned in the longitudinal direction are offset in the transverse direction by the amount of the dimension of a web (29).

4. Cassette according to claim 3, wherein two stack units (40, 41) are pluggable together to form a stack block (42) consisting of four cassettes (21*a* to 21*d*), the webs of the two stack unit (40, 41) being directed counter to one another, and webs (26) of one cassette (21*b*, 21*d*) of one stack unit (40, 41) entering said second orifices (38) of the confronting cassette (21*a*, 21*c*) of the other stack unit (40, 41).

5. Cassette according to claim 4, wherein stack units (40, 41), plugged together to form a stack block (42), are offset in the longitudinal direction of the cassettes (21) by the amount of half the width of a chamber (23) and are rotated through 180° relative to one another.

6. Cassette according to claim 3, wherein the cassettes (21) are protected in the stacked state against transverse shifts by means of centering lugs (35) on the top side of selected webs (30) and corresponding depressions (36) on the underside of the bottom wall (25).

7. Cassette according to claim 1, wherein, formed in the underside of the bottom wall (25), are retaining depressions (45) which allow said cassettes (21) to be secured on a conveyor.

* * * * *